US010959904B2

(12) United States Patent
Buckwaiter

(10) Patent No.: US 10,959,904 B2
(45) Date of Patent: Mar. 30, 2021

(54) SYSTEM AND METHOD FOR NAVIGATING A SPACE WHILE VISUALLY IMPAIRED

(71) Applicant: Owens Corning Intellectual Capital, LLC, Toledo, OH (US)

(72) Inventor: Daniel James Buckwaiter, Howard, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 697 days.

(21) Appl. No.: 15/825,215

(22) Filed: Nov. 29, 2017

(65) Prior Publication Data

US 2018/0147109 A1 May 31, 2018

Related U.S. Application Data

(60) Provisional application No. 62/428,024, filed on Nov. 30, 2016.

(51) Int. Cl.

| | |
|---|---|
| ***A61H 3/06*** | (2006.01) |
| ***A61H 35/02*** | (2006.01) |
| ***G08B 7/06*** | (2006.01) |

(52) U.S. Cl.

CPC ..... *A61H 3/061* (2013.01); *A61H 3/06* (2013.01); *G08B 7/066* (2013.01); *A61H 35/02* (2013.01); *A61H 2003/063* (2013.01); *A61H 2201/0173* (2013.01)

(58) Field of Classification Search

CPC ..... A61H 3/06; A61H 35/02; A61H 2003/063
USPC ..... 116/205
See application file for complete search history.

(56) References Cited

U.S. PATENT DOCUMENTS

| | | | | |
|---|---|---|---|---|
| 4,080,087 | A | 3/1978 | Phillips | |
| 4,385,586 | A * | 5/1983 | Schriever | A62B 3/00 116/205 |
| 4,620,816 | A | 11/1986 | Kupfer | |
| 5,366,050 | A * | 11/1994 | Raynes | G09B 21/003 182/18 |
| D378,432 | S * | 3/1997 | Raynes | G09B 21/003 D25/164 |
| 6,025,773 | A | 2/2000 | Bresnan | |
| 2003/0029372 | A1 | 2/2003 | Moore | |
| 2011/0296727 | A1 | 12/2011 | Savagian et al. | |
| 2013/0063249 | A1 | 3/2013 | Shofani | |
| 2016/0095794 | A1 | 4/2016 | Eveleigh et al. | |

FOREIGN PATENT DOCUMENTS

| | | |
|---|---|---|
| WO | 1993012837 | 7/1993 |

OTHER PUBLICATIONS

International Search Report and Written Opinion in PCT/US17/63580 dated Feb. 13, 2018.

* cited by examiner

*Primary Examiner* — Daniel S Larkin
(74) *Attorney, Agent, or Firm* — Calfee, Halter & Griswold LLP

(57) ABSTRACT

Systems for and methods of readily locating an eyewash station in a lab while visually impaired are provided.

20 Claims, 12 Drawing Sheets

SECTION C-C

SYSTEM AND METHOD FOR NAVIGATING A SPACE WHILE VISUALLY IMPAIRED

CROSS REFERENCE TO RELATED APPLICATIONS

This application claims priority to and any benefit of U.S. Provisional Patent Application No. 62/428,024, filed Nov. 30, 2016, the content of which is incorporated herein by reference in its entirety.

FIELD

The general inventive concepts relate to navigation within an environment and, more particularly, to systems for and methods of navigating a space while visually impaired.

BACKGROUND

Laboratories present a potentially dangerous workspace. Chemicals and related apparatus are often manipulated on lab benches within the laboratory. Notwithstanding safety precautions, such as wearing eye protection, there remains a risk of injury from chemicals accidentally entering the eyes of those working in the lab. Consequently, as a safety precaution, it is common for a lab to include an eye wash station. As known in the art, the eye wash station includes a bifurcated faucet for simultaneously delivering streams of water to a pair of eyes upon activation. The streams of water contact the eyes and flush the chemicals therefrom. The eye wash station may also include a sink or similar basin for draining the water being delivered by the faucet.

Unfortunately, a person with chemicals in their eyes may be visually impaired so as to make quickly finding the eye wash station difficult and dangerous. This is particularly problematic given that the damage to the eyes from the chemical may increase the longer the chemical remains in the eyes. Consequently, there is an unmet need for systems for and methods of easily, quickly, and safely locating an eye wash station within a lab while visually impaired.

SUMMARY

The general inventive concepts relate to and contemplate systems for, methods of, and related structure facilitating the quick location of an eyewash station while visually impaired.

In one exemplary embodiment, a system for locating an eyewash station in a laboratory is provided. The system comprises: a tactile guide strip defining a path from a first location in the lab remote from the eyewash station to a second location in the lab proximate the eyewash station, wherein the tactile guide strip provides a first tactile sensation upon movement of a hand along the tactile guide strip in a first direction and a second tactile sensation upon movement of the hand along the tactile guide strip in a second direction opposite the first direction.

In some exemplary embodiments, the first location is more than 1 foot away from the eyewash station. In some exemplary embodiments, the first location is more than 6 feet away from the eyewash station.

In some exemplary embodiments, the second location is within 6 inches of the eyewash station. In some exemplary embodiments, the second location is within 1 inch of the eyewash station. In some exemplary embodiments, the second location overlaps with the eyewash station.

In some exemplary embodiments, the laboratory includes a plurality of eyewash stations and the tactile guide strip defines a path to the closest one of the eyewash stations.

In some exemplary embodiments, the tactile guide strip includes a textured surface and at least one raised ridge adjacent to and extending higher than the textured surface. In some exemplary embodiments, the textured surface can be felt through lab gloves.

In some exemplary embodiments, a discontinuity in the tactile guide strip represents the second location.

In some exemplary embodiments, an activation means is situated in the discontinuity, wherein manipulation of the activation means triggers an alarm. In some exemplary embodiments, the activation means is a button. In some exemplary embodiments, the alarm includes at least one of a visible alarm and an audible alarm.

In some exemplary embodiments, the system further comprises at least one tactile guide arrow situated along the path, wherein the tactile guide arrow indicates a direction of travel across an open space that must be traversed before the path resumes. In some exemplary embodiments, the open space is a distance of at least 1 foot.

In some exemplary embodiments, the tactile guide arrow includes a protective hood.

In one exemplary embodiment, a method of locating an eyewash station in a laboratory by a visually-impaired individual is provided. The method comprises: locating by touch a tactile guide strip mounted within the lab, the tactile guide strip defining a path from a first location in the lab remote from the eyewash station to a second location in the lab proximate the eyewash station; feeling the tactile guide strip to determine a direction of travel based on the difference between a first tactile sensation experienced by the individual moving a hand along the tactile guide strip in a first direction and a second tactile sensation experienced by the individual moving the hand along the tactile guide strip in a second direction opposite the first direction; and following the path in the direction to the eyewash station.

In some exemplary embodiments, the first location is more than 1 foot away from the eyewash station. In some exemplary embodiments, the first location is more than 6 feet away from the eyewash station.

In some exemplary embodiments, the second location is within 6 inches of the eyewash station. In some exemplary embodiments, the second location is within 1 inch of the eyewash station. In some exemplary embodiments, the second location overlaps with the eyewash station.

In some exemplary embodiments, the laboratory includes a plurality of eyewash stations and the tactile guide strip defines a path to the closest one of the eyewash stations.

In some exemplary embodiments, the tactile guide strip includes a textured surface and at least one raised ridge adjacent to and extending higher than the textured surface. In some exemplary embodiments, the textured surface can be felt through lab gloves.

In some exemplary embodiments, a discontinuity in the tactile guide strip represents the second location.

In some exemplary embodiments, an activation means is situated in the discontinuity, wherein manipulation of the activation means triggers an alarm. In some exemplary embodiments, the activation means is a button. In some exemplary embodiments, the alarm includes at least one of a visible alarm and an audible alarm.

In some exemplary embodiments, the method further comprises locating by touch at least one tactile guide arrow situated along the path, wherein the tactile guide arrow indicates a direction of travel across an open space that must be traversed before the path resumes. In some exemplary embodiments, the open space is a distance of at least 1 foot.

In some exemplary embodiments, the tactile guide arrow includes a protective hood.

In one exemplary embodiment, a kit for installing a tactile guide system in a laboratory to facilitate location of an eyewash station in the laboratory by a visually-impaired individual is provided. The kit comprises: a length of tactile guide strip for mounting within the laboratory to define a path from a first location in the lab remote from the eyewash station to a second location in the lab proximate the eyewash station, wherein the tactile guide strip provides a first tactile sensation upon movement of a hand along the tactile guide strip in a first direction and a second tactile sensation upon movement of the hand along the tactile guide strip in a second direction opposite the first direction.

In some exemplary embodiments, the tactile guide strip is in the form of a roll.

In some exemplary embodiments, the length of the tactile guide strip is at least 10 feet long.

In some exemplary embodiments, the tactile guide strip can be cut into a plurality of pieces to define the path.

In some exemplary embodiments, the tactile guide strip includes a textured surface and a mounting means on the opposite surface. In some exemplary embodiments, the mounting means is an adhesive. In some exemplary embodiments, the mounting means is a hook and loop fastener.

In some exemplary embodiments, the kit further comprises at least one tactile guide arrow, wherein the tactile guide arrow can be situated along the path to indicate a direction of travel across an open space that must be traversed before the path resumes.

Numerous other aspects, advantages, and/or features of the general inventive concepts will become more readily apparent from the following detailed description of exemplary embodiments, from the claims, and from the accompanying drawings being submitted herewith.

BRIEF DESCRIPTION OF THE DRAWINGS

The general inventive concepts, as well as embodiments and advantages thereof, are described below in greater detail, by way of example, with reference to the drawings in which:

FIG. 1A shows a top view of the tactile guide member. FIG. 1B shows a cross-sectional view of the tactile guide member, as viewed along line C-C of FIG. 1. FIG. 1C shows the tactile guide member mounted to a lab bench.

FIG. 2A shows a side, separated view of the tactile guide member. FIG. 2B shows a top view of the tactile direction member. FIG. 2C shows a bottom view of the tactile direction member. FIG. 2D shows the tactile direction member mounted to a lab bench.

DETAILED DESCRIPTION

Figure 1A:
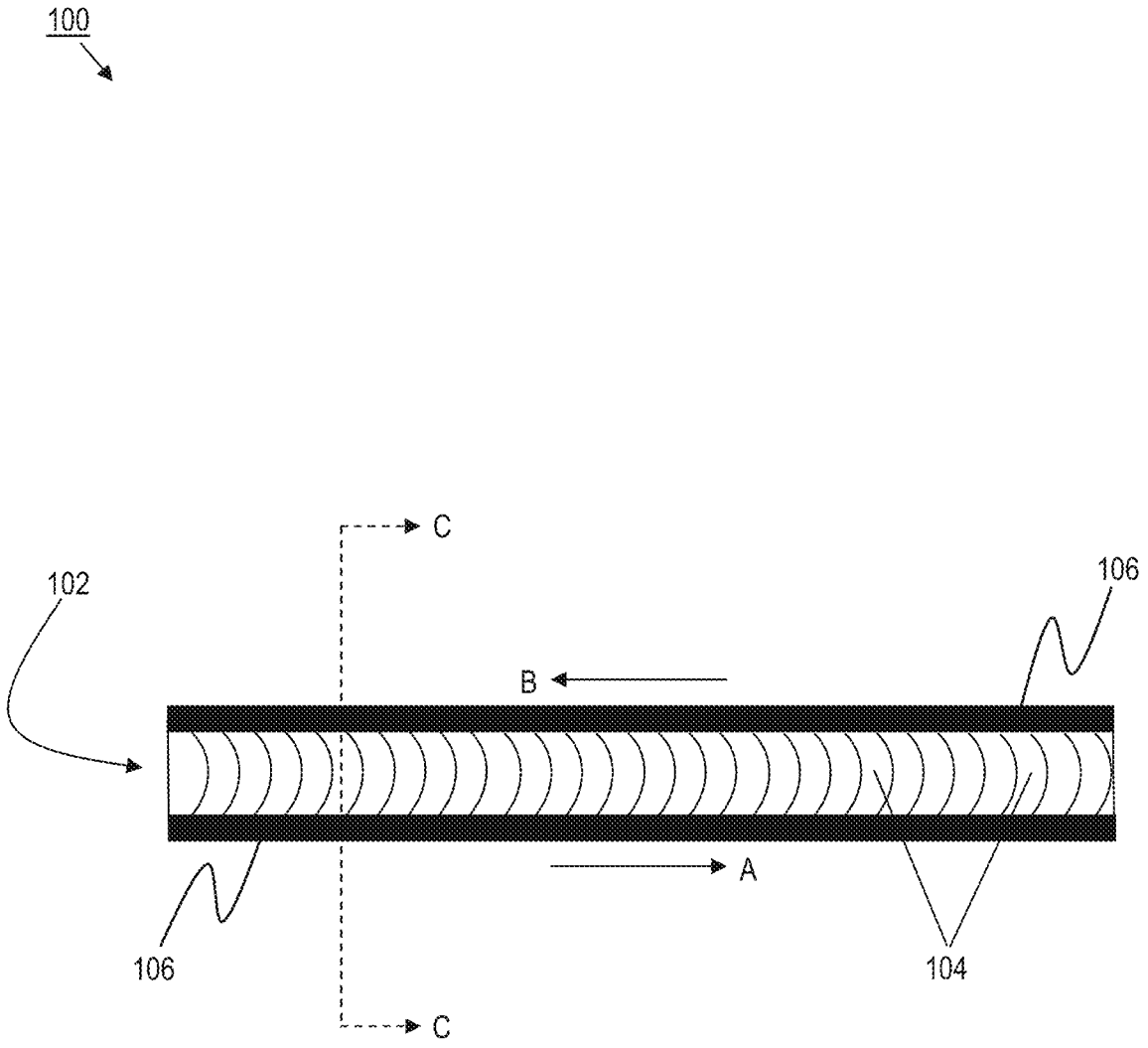
FIGS. 1A-1C are diagrams illustrating a tactile guide member for a lab bench, according to one exemplary embodiment.

While the general inventive concepts are susceptible of embodiment in many different forms, there are shown in the drawings, and will be described herein in detail, specific embodiments thereof with the understanding that the present disclosure is to be considered as an exemplification of the principles of the general inventive concepts. Accordingly, the general inventive concepts are not intended to be limited to the specific embodiments illustrated herein.

Figure 1B:
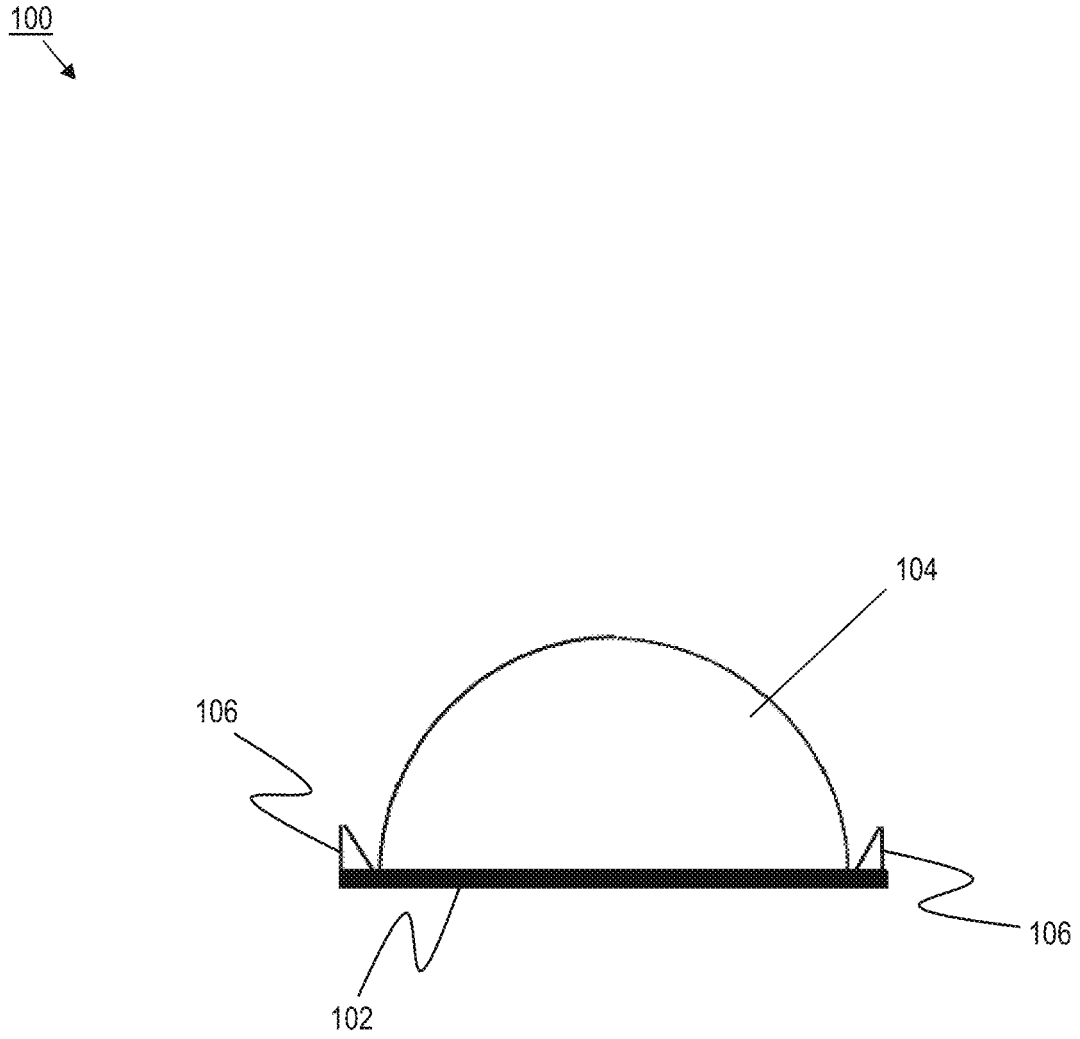
Figure 1C:
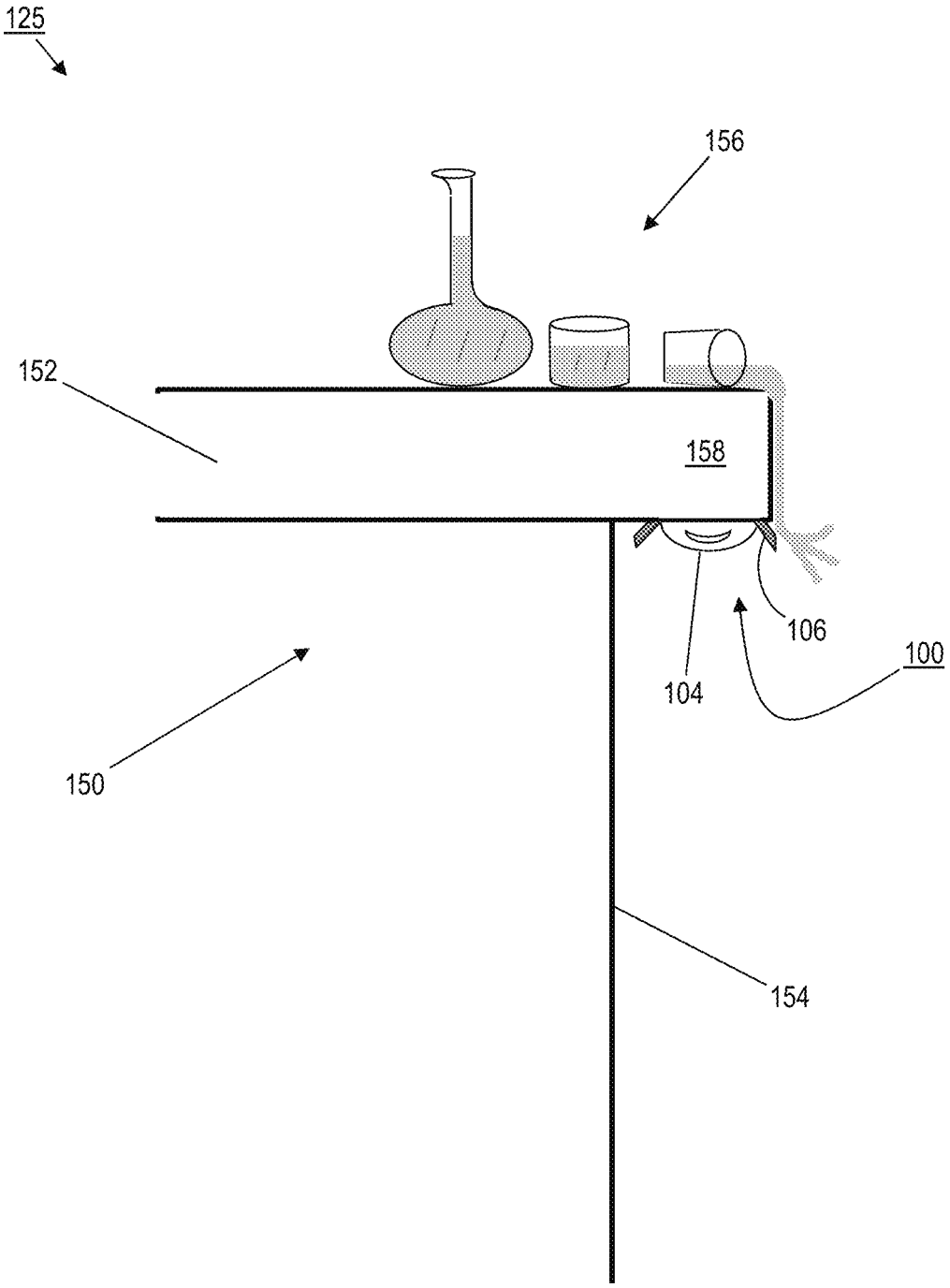

As shown in FIGS. 1A-1C, a tactile guide member, according to one exemplary embodiment, takes the form of a tactile guide strip 100. The tactile guide strip 100 can be made of any suitable base material 102. Typically, the base material 102 is inherently chemical resistant or otherwise treated to be so. In one exemplary embodiment, the tactile guide strip 100 is made of plastic. The tactile guide strip 100 includes a plurality of raised portions 104. Alternatively, in some exemplary embodiments, the tactile guide strip 100 could include a plurality of indentations or lowered portions.

The raised portions 104 are angled or otherwise oriented so that movement of one's hand across a surface of the tactile guide strip 100 in a first direction (corresponding to arrow A in FIG. 1) will provide a first tactile sensation (e.g., feel relatively smooth or pleasant to the touch), while movement of one's hand across the surface of the tactile guide strip 100 in a second direction (corresponding to arrow B in FIG. 1), which is opposite the first direction, will provide a second tactile sensation (e.g., feel relatively rough or unpleasant to the touch). In some exemplary embodiments, at least a portion of each raised portion 104 overlaps with a portion of an adjacent raised portion 104. In some exemplary embodiments, the difference in tactile sensation between the first direction and the second direction is sufficient to be felt through gloves being worn in the lab.

By positioning the tactile guide strip 100 in a particular direction, it can be used to define a path to an eyewash station (e.g., the eyewash station 450) within the lab. In the case of a lab having multiple eyewash stations, the path will typically lead to the closest eyewash station. In this manner, a person that has become visually impaired within the lab due to a chemical splash to the eyes can readily navigate to the closest eyewash station and begin the process of flushing their eyes.

As a further feature, the tactile guide strip 100 includes a pair of drip ridges 106 that each extend along a length of the tactile guide strip 100 on opposite edges thereof. The drip ridges 106 can be sized and/or shaped in any suitable manner. In some exemplary embodiments, a portion of each drip ridge 106 can extend beyond a width of the base material 102. The drip ridges 106 prevent spilled chemicals from contaminating the tactile guide strip 100. As shown in FIG. 1C, this is typically done by directing the spilled chemical away from the tactile guide strip 100. In some exemplary embodiments, the tactile guide strip 100 may only include a single drip ridge 106 that extends along a length of one edge thereof.

An installation 125 of the tactile guide strip 100 on a lab bench 150 is shown in FIG. 1C. The lab bench 150 includes an upper portion 152 and a lower portion 154 that supports the upper portion 152. The upper portion 152 defines a work space on which chemicals 156 and other related apparatuses (not shown) are often placed and manipulated. It is common for the upper portion 152 of the lab bench 150 to extend beyond the lower portion 154 so as to form a ledge 158 or overhang. In one exemplary embodiment, the tactile guide strip 100 is installed beneath the ledge 158. In this manner, the tactile guide strip 100 is less likely to be damaged or contaminated during normal operation of the lab. Furthermore, placement of the tactile guide strip 100 below the ledge 158 reduces the likelihood that an impaired individual will disrupt the chemicals 156 and other equipment on the work space, which in turn reduces the risk of injury to the individual or others in the lab and/or reduces the risk of damage to the lab or equipment therein.

In some exemplary embodiments, at least a portion of the installation 125 includes a tactile guide strip 100 that is mounted on a horizontal surface other than the lab bench 150 (e.g., a floor). In some exemplary embodiments, at least a portion of the installation 125 includes a tactile guide strip 100 that is mounted on a vertical surface other than the lab bench 150 (e.g., a wall, a door).

Because the lab bench 150 and the tactile guide strip 100 installed thereon are relatively easy to find through touch alone, a visually impaired person can more readily locate an eye wash station in the lab. In some exemplary embodiments, as a precursor to working in the lab, individuals can be made aware of the tactile guide strip 100 (i.e., its location and function).

The tactile guide strip 100 can have any suitable length and/or width, so long as the aforementioned tactile sensations can be readily felt. In the exemplary embodiment shown in FIG. 1C, a width of the tactile guide strip 100 is chosen to be less than or approximately equal to a width of the ledge 158. In some exemplary embodiments, the tactile guide strip 100 is formed as a continuous member that is cut into pieces having desired lengths on site during installation. Such a continuous member could form part of an installation kit for a lab.

As shown in FIGS. 2A-2D, a tactile direction member, according to one exemplary embodiment, takes the form of a tactile guide arrow 200. In general, the tactile guide arrow 200 will be situated adjacent to a tactile guide strip 100 or in a gap between two pieces of the tactile guide strip 100, such that the tactile guide strip 100 leads the impaired individual to the tactile guide arrow 200.

The tactile guide arrow 200 can be made of any suitable base material (e.g., the base material 102). Typically, the base material is inherently chemical resistant or otherwise treated to be so. In one exemplary embodiment, the tactile guide arrow 200 is made of plastic. The tactile guide arrow 200 includes an upper portion 202, a spacer 204, and an arrow body 206.

Figure 2A:
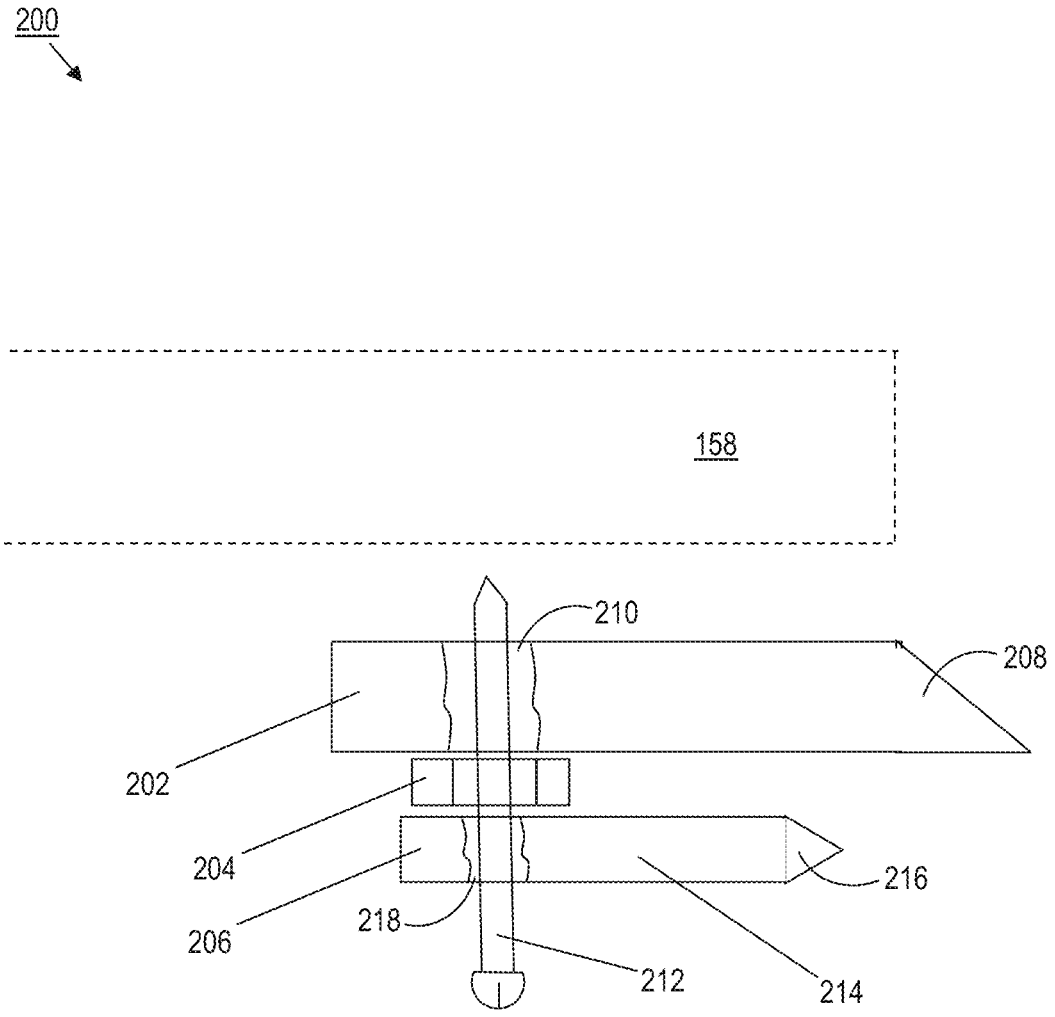
FIGS. 2A-2D are diagrams illustrating a tactile direction member for a lab bench, according to one exemplary embodiment.
Figure 2B:
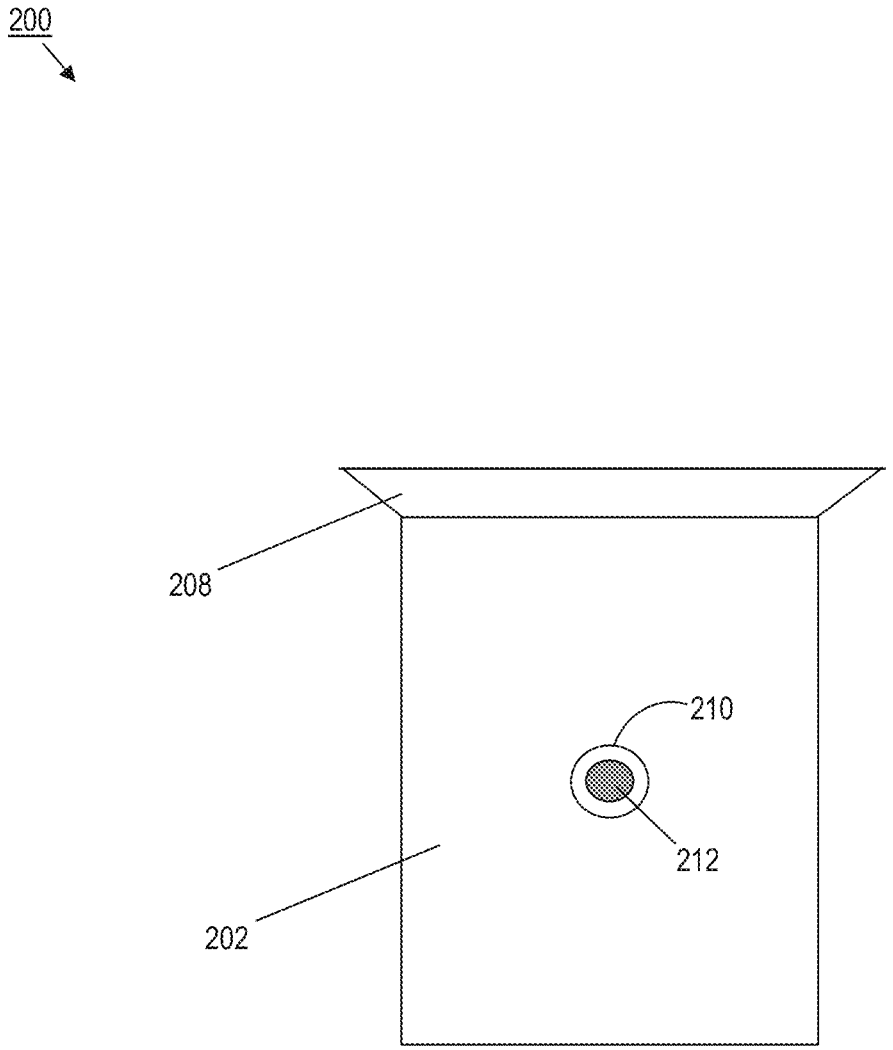
Figure 2C:
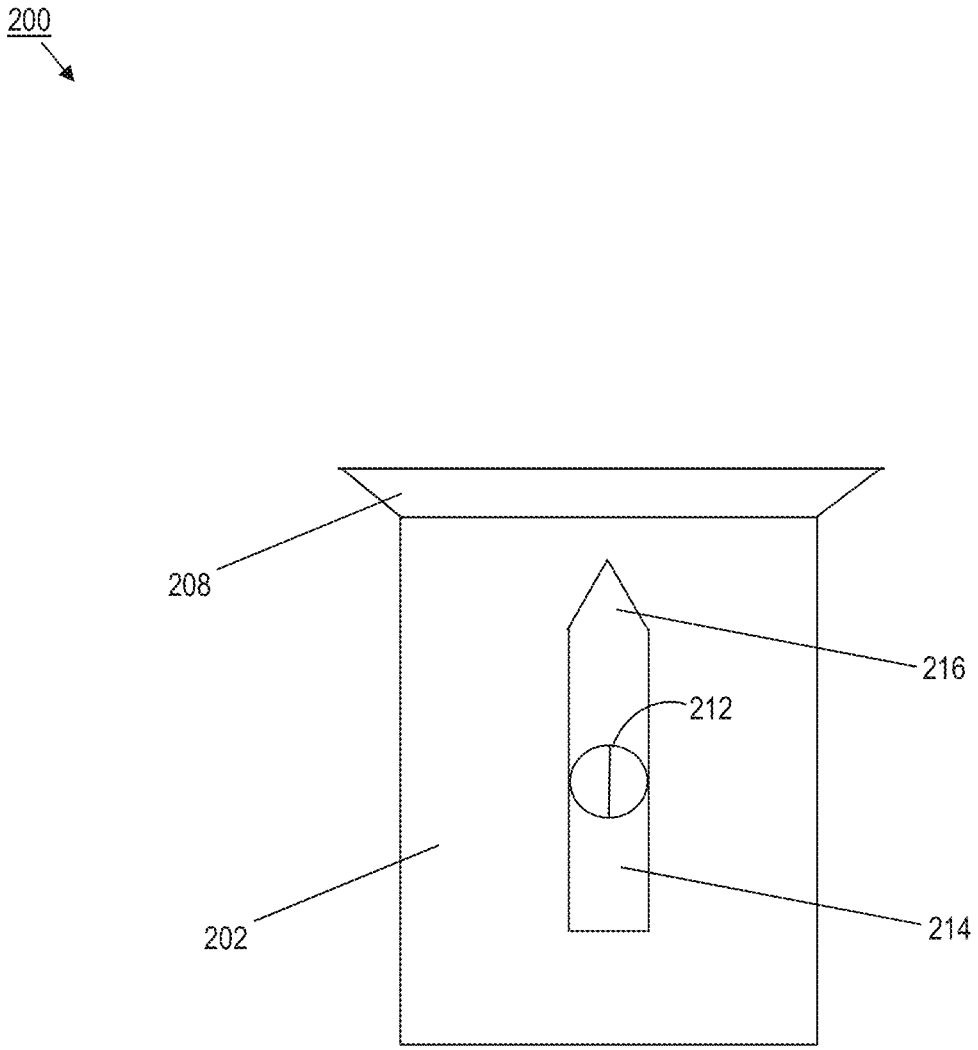
Figure 2D:
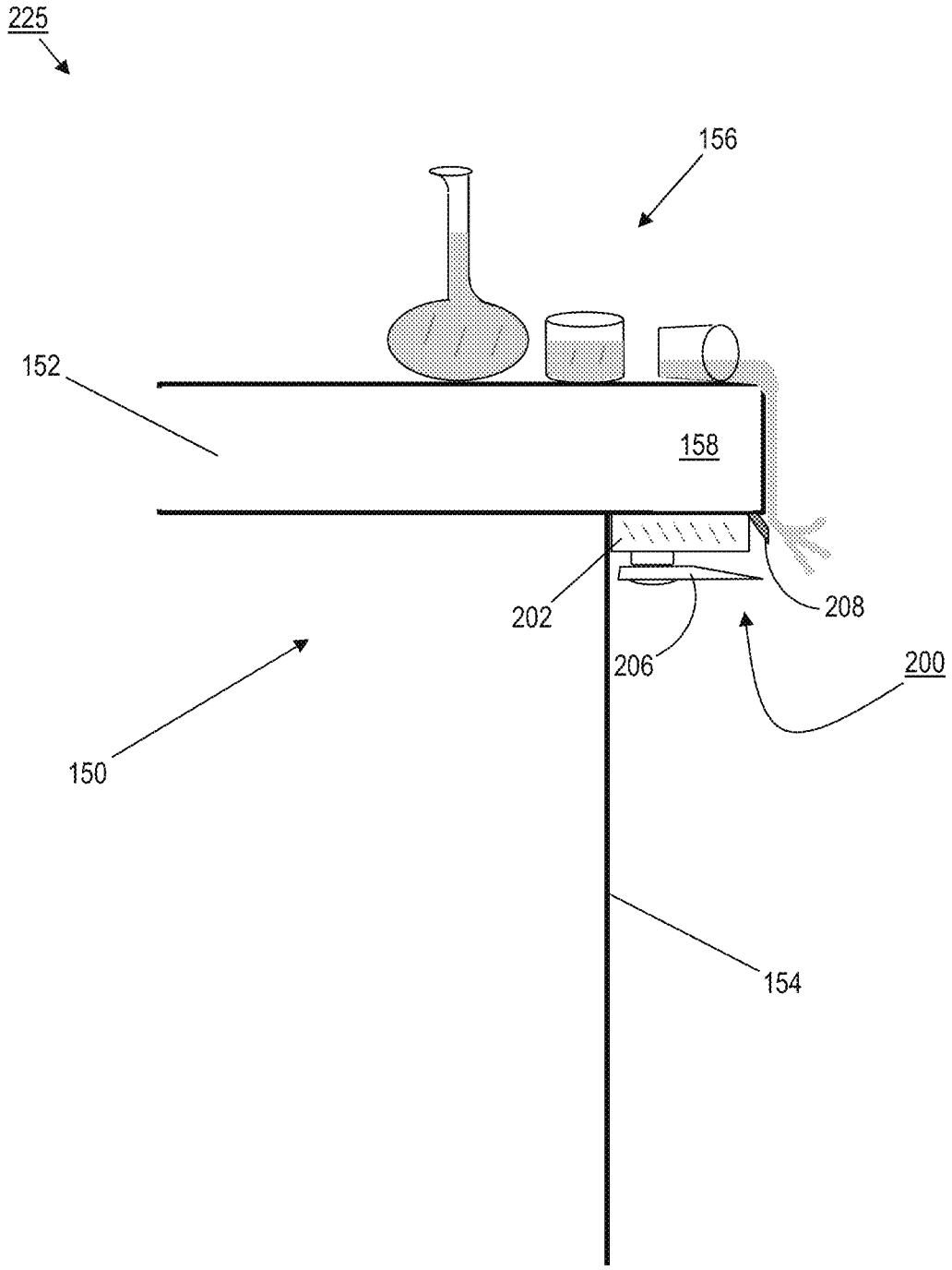

The upper portion 202 of the tactile guide arrow 200 includes a hood 208 or similar structure (e.g., a drip ridge 106). The hood 208 can be sized and/or shaped in any suitable manner. In general, the dimensions of the upper portion 202 (including the hood 208) will be larger than the dimensions of the arrow body 206, so that the upper portion 202 effectively shields the arrow body 206 situated below it. The hood 208 prevents spilled chemicals from contaminating the tactile guide arrow 200. As shown in FIG. 2D, this is typically done by directing the spilled chemical away from the tactile guide arrow 200. The upper portion 202 also includes a hole 210 (see FIG. 2B) that allows a mounting member, for example, screw 212, to pass therethrough and into a mounting surface, for example, ledge 158 (see FIG. 2D).

The spacer 204 separates the arrow body 206 from the upper portion 202 of the tactile guide arrow 200 so that the arrow body 206 may be more readily identified by touch. In some exemplary embodiments, the spacer 204 is a washer. Like the upper portion 202, the spacer 204 includes a hole (unlabeled in FIG. 2B) that allows the screw 212 to pass therethrough.

The arrow body 206 includes an elongated shaft 214 that tapers into a narrowed or otherwise pointed section 216. The arrow body 206 and, in particular, the pointed section 216 is angled or otherwise aimed upon installation to point in a direction that a person seeking the eyewash station needs to travel. For example, a transition from the tactile guide strip 100 to the tactile guide arrow 200 alerts the person following same to leave the tactile guide strip 100 and walk in the direction indicated by the tactile guide arrow 200. This will typically mean crossing an open space. The open space will often span several inches or more (e.g., 1 foot or more) and may be a hall, aisle, etc. In this manner, the person will either reach their ultimate destination (e.g., the eyewash station) or reach another tactile guide strip 100 that will continue the path to said destination. Like the upper portion 202, the arrow body 206 includes a hole 218 (see FIG. 2A) that allows the screw 212 to pass therethrough.

An installation 225 of the tactile guide arrow 200 on a lab bench 150 is shown in FIG. 2D. As noted above, the lab bench 150 includes the upper portion 152 and the lower portion 154, as well as the ledge 158 formed where the upper portion 152 extends beyond the lower portion 154. The upper portion 152 defines a work space on which chemicals 156 and other related apparatuses (not shown) are often placed and manipulated. In one exemplary embodiment, the tactile guide arrow 200 is installed beneath the ledge 158. In this manner, the tactile guide arrow 200 is less likely to be damaged or contaminated during normal operation of the lab.

Because the lab bench 150 and the tactile guide arrow 200 installed thereon are relatively easy to find through touch alone, a visually impaired person can more readily locate an eye wash station in the lab.

Figure 3:
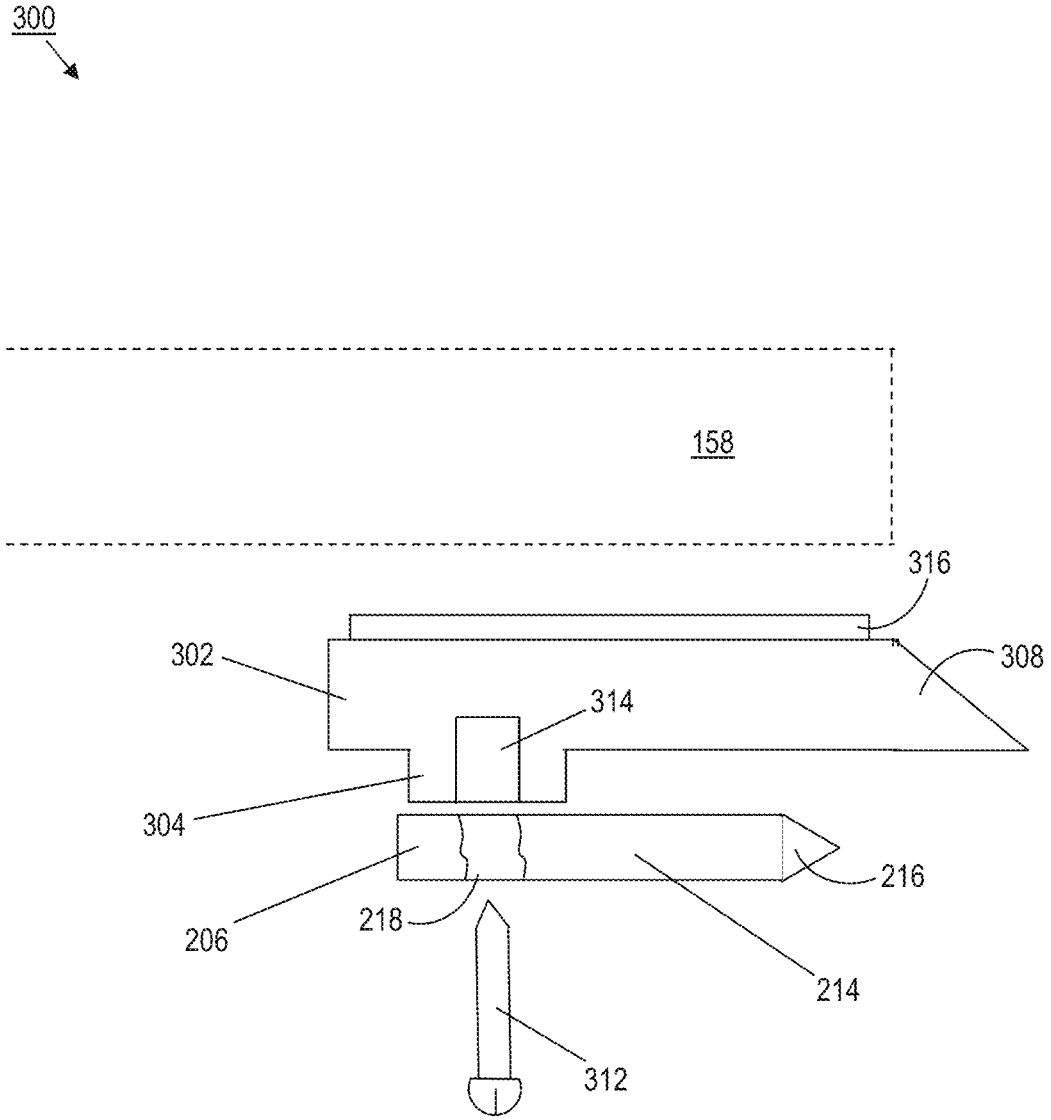
FIG. 3 is a diagram showing a tactile direction member, according to another exemplary embodiment.

FIG. 3 is a diagram showing a tactile direction member, according to another exemplary embodiment.

As shown in FIG. 3, a tactile direction member, according to another exemplary embodiment, takes the form of a tactile guide arrow 300. The tactile guide arrow 300 can be made of any suitable base material (e.g., the base material 102). Typically, the base material is inherently chemical resistant or otherwise treated to be so. In one exemplary embodiment, the tactile guide arrow 300 is made of plastic. The tactile guide arrow 300 includes an upper portion 302 and an arrow body 206.

The upper portion 302 of the tactile guide arrow 300 includes a boss 304 and a hood 308 or similar structure (e.g., a drip ridge 106). The boss 304 extends from a lower surface of the upper portion 302. The boss 304 separates the arrow body 206 from the upper portion 302 of the tactile guide arrow 300 so that the arrow body 206 may be more readily identified by touch. The hood 308 can be sized and/or shaped in any suitable manner. In general, the dimensions of the upper portion 302 (including the hood 308) will be larger than the dimensions of the arrow body 206, so that the upper portion 302 effectively shields the arrow body 206 situated below it. The hood 308 prevents spilled chemicals from contaminating the tactile guide arrow 300. This is typically done by directing the spilled chemical away from the tactile guide arrow 300.

As noted above, the arrow body 206 includes an elongated shaft 214 that tapers into a narrowed or otherwise pointed section 216. The arrow body 206 and, in particular, the pointed section 216 is angled or otherwise aimed upon installation to point in a direction that a person seeking the eyewash station needs to travel. For example, a transition from the tactile guide strip 100 to the tactile guide arrow 300 alerts the person following same to leave the tactile guide strip 100 and walk in the direction indicated by the tactile guide arrow 300. This will typically mean crossing an open space. The open space will often span several inches or more (e.g., 1 foot or more) and may be a hall, aisle, etc. In this manner, the person will either reach their ultimate destination (e.g., the eyewash station) or reach another tactile guide strip 100 that will continue the path to said destination. The arrow body 206 includes a hole 218 that allows an assembly screw 312 to pass therethrough.

The upper portion 302 including the boss 304 define a cavity 314 for interfacing with the assembly screw 312 to affix the components of the tactile guide arrow 300 to one another. Thus, the assembly screw 312 does not mount the tactile guide arrow 300 to the ledge 158. Instead, the tactile guide arrow 300 includes a mounting means, for example, an adhesive strip 316, disposed on an upper surface of the upper portion 302. The adhesive strip 316 secures the tactile guide arrow 300 to the ledge 158.

It will be appreciated by one of ordinary skill in the art that various systems for and methods of readily locating an eyewash station in a lab while visually impaired can be implemented/practiced using the tactile guide members and tactile direction members disclosed and suggested herein.

Figure 4:
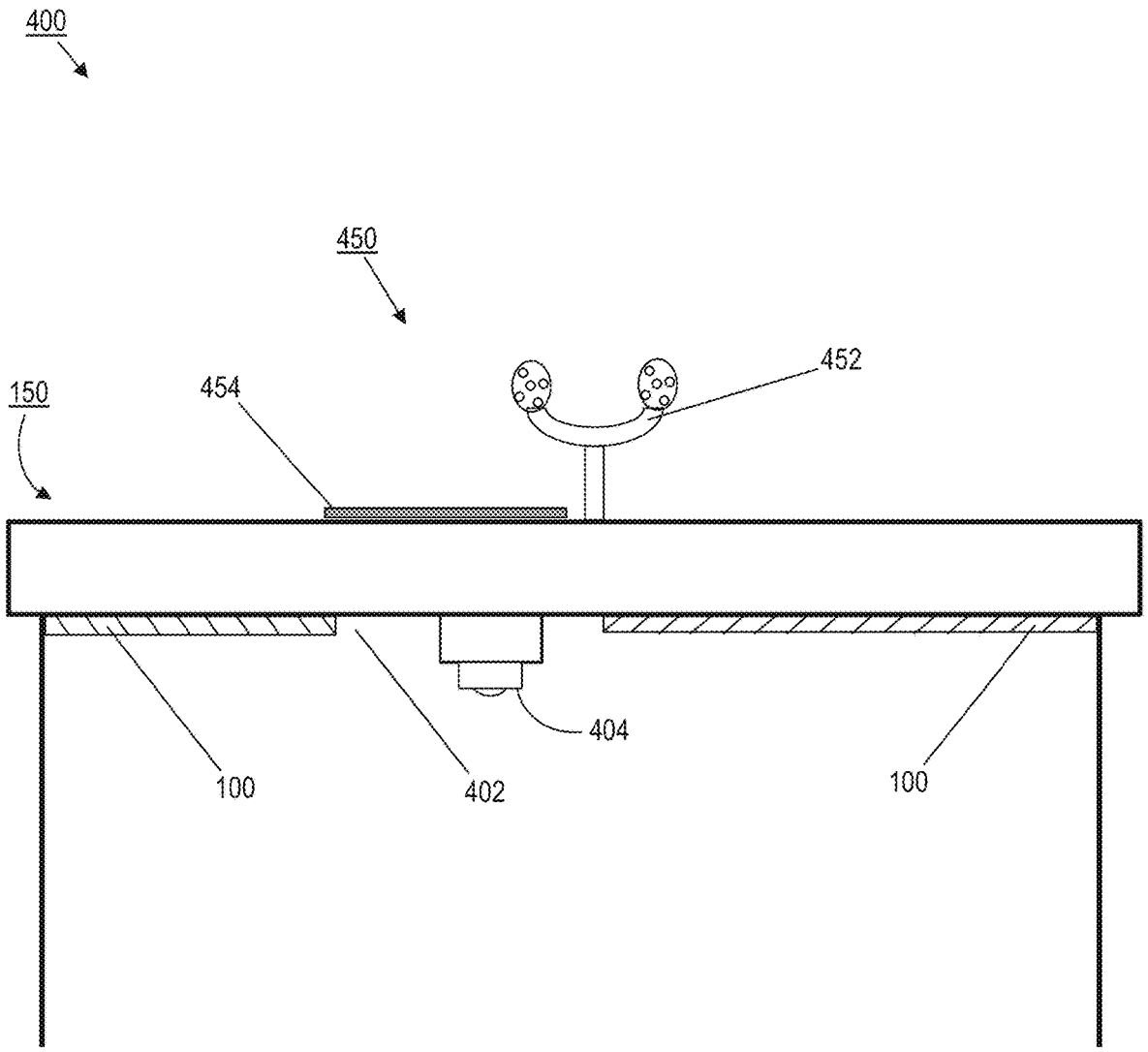
FIG. 4 is a diagram showing an alarm member, according to one exemplary embodiment.

It will also be appreciated that such systems/methods could be expanded to add increased functionality thereto and/or otherwise improve operation thereof. For example, as shown in FIG. 4, an installation 400 of tactile guide strips 100 on a lab bench 150 includes a gap 402 or break in the tactile guide strips 100. The gap 402 can be used to indicate, by touch alone, a location of an eyewash station 450 located on top of the lab bench 150. The eyewash station 450 includes a bifurcated faucet 452 and a sink/drain 454.

As another example, an alarm activation member, for example, a button 404, can be situated in proximity to the eyewash station 450. In some exemplary embodiments, the button 404 is positioned within the gap 402. In some exemplary embodiments, the button 404 is centered within the gap 402. The button 404 can include additional structure (e.g., drip ridge 106) to protect it from chemical contamination. Activation of the button 404 initiates an alarm or signal that can alert others outside the lab that an incident has occurred. The alarm could be, for example, audible or visual. The signal could be used to generate an automatic electronic message for delivery to a predetermined person or persons (e.g., a facility safety officer, first responders). In some exemplary embodiments, the button 404 is also used to activate the eyewash station 450.

It will also be appreciated by one of ordinary skill in the art that various other applications, beyond locating an eyewash station in a lab, exist for the general inventive concepts presented herein. For example, the general inventive concepts might find applicability in rooms designed for the blind, in an environment with little or no light (e.g., a cave, a mine), in a space (e.g., inside an airplane) filled with smoke, etc.

Figure 5:
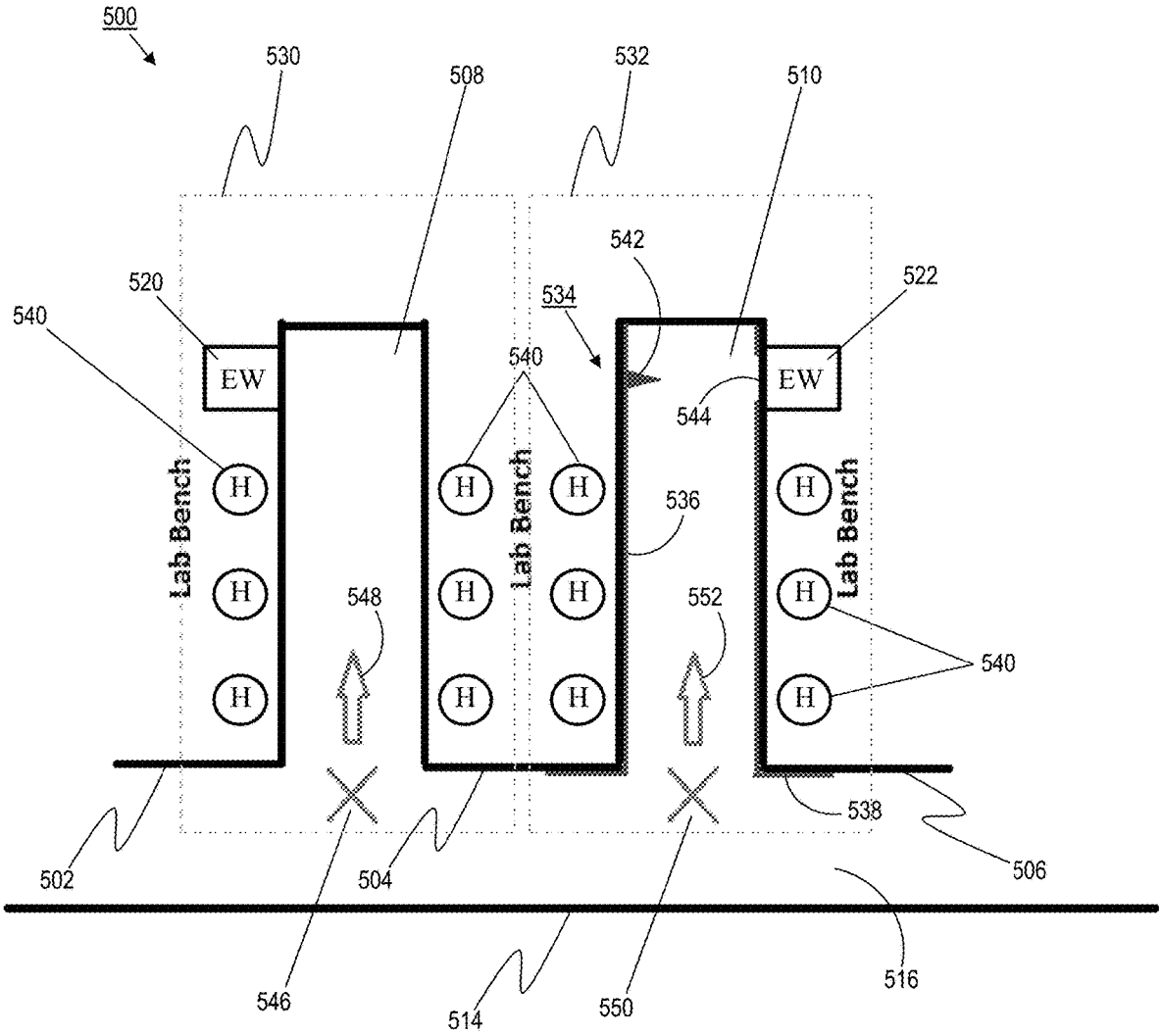
FIG. 5 is a diagram of the layout of a laboratory in which an exemplary system for guiding a visually impaired individual to an eyewash station was tested.

The efficacy of various aspects of the general inventive concepts was assessed in the context of an actual laboratory. A diagram of the relevant portions of the lab 500 in which the testing was carried out is shown in FIG. 5.

The lab 500 includes a first lab bench 502, a second lab bench 504, and a third lab bench 506. A portion of the first lab bench 502 and the second lab bench 504 is separated by a first aisle 508 situated therebetween. The first aisle 508 allows a person in the lab 500 to work on the first lab bench 502 and/or the second lab bench 504. A portion of the second lab bench 504 and the third lab bench 506 is separated by a second aisle 510 situated therebetween. The second aisle 510 allows a person in the lab 500 to work on the second lab bench 504 and/or the third lab bench 506. The first aisle 508 and the second aisle 510 have the same dimensions, including a width of approximately 6 ft.

A wall 514 in the lab 500 defines a third aisle 516 that runs perpendicular to the first aisle 508 and the second aisle 510. The third aisle 516 allows a person in the lab 500 to move between the first aisle 508 and the second aisle 510.

In the lab 500, a first eyewash station 520 is situated on the first lab bench 502 near the end of the first aisle 508, while a second eyewash station 522 is situated on the third lab bench 506 near the end of the second aisle 510.

Thus, as configured, the lab 500 represented a first testing zone 530 and a second testing zone 532. The first testing zone 530 included the portion of the first lab bench 502 facing the first aisle 508 and the portion of the second lab bench 504 facing the first aisle 508. The first eyewash station 520 was located in the first testing zone 530. The second testing zone 532 included the portion of the second lab bench 504 facing the second aisle 510 and the portion of the third lab bench 506 facing the second aisle 510. The second eyewash station 522 was located in the second testing zone 532.

For safety reasons, a work space on each of the lab benches 502, 504, 506 was substantially cleared of chemicals and equipment prior to commencing the testing. To simulate an actual lab environment, mock hazards 540 were placed on the work space of each lab bench instead. As can be seen in FIG. 5, three relatively evenly spaced mock hazards 540 were situated on the work space of each portion of the lab benches 502, 504, 506 facing one of the aisles 508, 510.

The first testing zone 530, considered the control testing zone, did not include any tactile guide system. Conversely, the second testing zone 532 included a tactile guide system 534. The tactile guide system 534 included a first tactile guide strip 536 (e.g., the tactile guide strip 100) placed below a work space and running a length of the portion of the second lab bench 504 facing the second aisle 510 and partially extending on the portion of the second lab bench 504 facing the third aisle 516. The tactile guide system 534 also included a second tactile guide strip 538 (e.g., the tactile guide strip 100) placed below a work space and running a length of the portion of the third lab bench 506 facing the second aisle 510 and partially extending on the portion of the third lab bench 506 facing the third aisle 516.

The tactile guide system 534 included a tactile guide arrow 542 (e.g., the tactile guide arrow 200) placed along the path of the first tactile guide strip 536 directly across from the second eyewash station 522. For purposes of illustration only, a size of the tactile guide arrow 542 is greatly exaggerated in FIG. 5. A tip of the tactile guide arrow 542 was angled to point directly across the second aisle 510 toward the second eyewash station 522.

Finally, the tactile guide system 534 included a break 544 or open portion in the second tactile guide strip 538. The break 544 in the second tactile guide strip 538 was in proximity to the second eyewash station 522 and was intended to signal that the impaired individual had reached the location of the second eyewash station 522.

For testing purposes, six (6) individuals were selected to participate in evaluation. The participants were first given a brief overview of how the inventive tactile guide system (e.g., the tactile guide system 534) functions. This overview consisted of a short slide presentation on how the system works, as well as passing around a small sample piece of the tactile guide strip to the participants so that they could feel it to better understand its operation.

As shown in Table 1, the participants had varying degrees of familiarity with the testing environment (i.e., the lab 500). These degrees of familiarity spanned across low (i.e., never being in the lab 500 before), medium (i.e., working in the lab 500 one day a week on average), and high (i.e., working in the lab 500 all day, every day).

The participants were blindfolded to simulate vision impairment and then led into the lab 500 to a designated starting point.

The participants were not told whether the tactile guide system was present or not. Instead, the participants were simply told that they would participate in two test runs, one of which would include the tactile guide system and one of which would not.

Initially, half of the participants were led to the starting point 546 in proximity to the entrance of the first aisle 508 off the third aisle 516 (i.e., in the first testing zone 530), while the other half of the participants were led to the starting point 550 in proximity to the entrance of the second aisle 510 off the third aisle 516 (i.e., in the second testing zone 532). Once all of the participants had completed the test in their original testing zone, they were moved to the other testing zone to again repeat the test.

Those participants at the starting point 546 in proximity to the entrance of the first aisle 508 off the third aisle 516 (i.e., in the first testing zone 530) were faced in a direction (indicated by arrow 548) of the first aisle 508. The participants were then instructed to locate the eyewash station 520 by touch alone. The time (in seconds) that it took each participant to locate the eyewash station 520 is noted in Table 1. No outside intervention occurred during the testing, aside from several evaluators shadowing the participants to make sure that no actual harm (e.g., tripping) occurred to the participants during the test.

How many of the mock hazards 540 in the first testing zone 530 were disrupted as each participant attempted to locate the eyewash station 520 was also observed. This information is noted in Table 3.

Next, those participants at the starting point 550 in proximity to the entrance of the second aisle 510 off the third aisle 516 (i.e., in the second testing zone 532) were faced in a direction (indicated by arrow 552) of the second aisle 510. The participants were then instructed to locate the eyewash station 522 by touch alone. The time (in seconds) that it took each participant to locate the eyewash station 522 is noted in Table 1. No outside intervention occurred during the testing, aside from several evaluators shadowing the participants to make sure that no actual harm (e.g., tripping) occurred to the participants during the test.

How many of the mock hazards 540 in the second testing zone 532 were disrupted as each participant attempted to locate the eyewash station 522 was also observed. This information is noted in Table 3.

Figure 6:
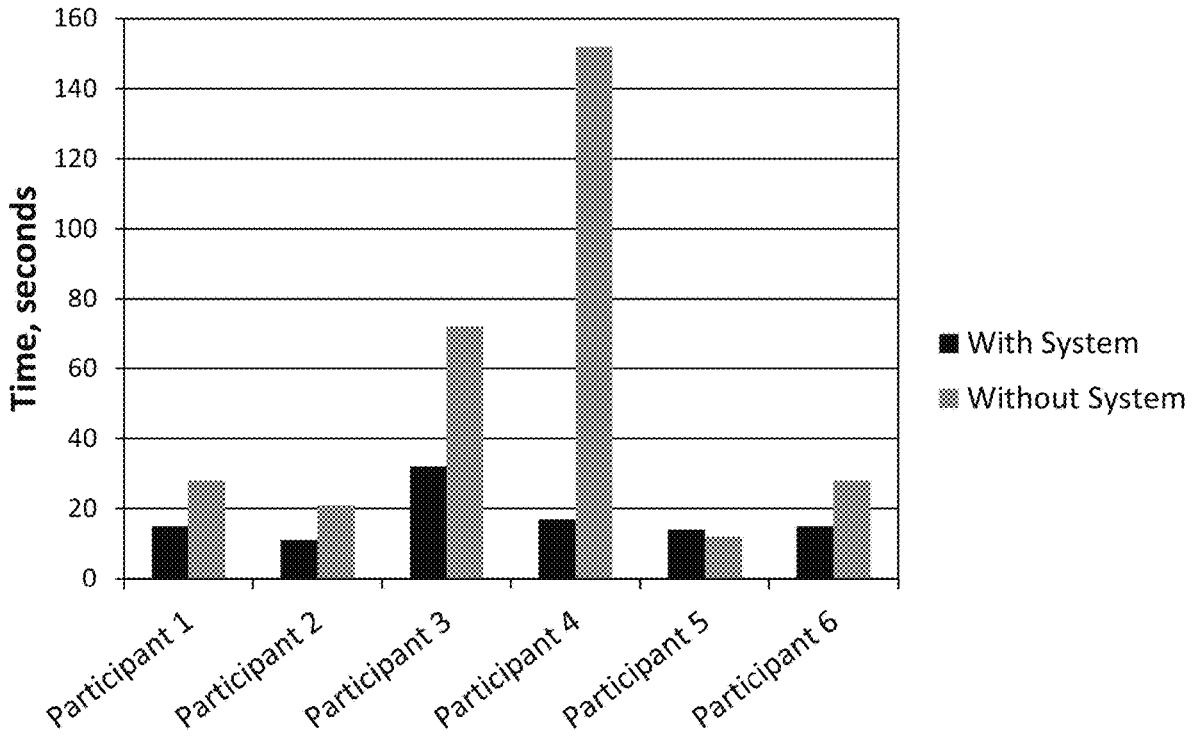
FIG. 6 is a graph comparing the time (in seconds) for Participants 1-6 to locate an eyewash station with and without the use of a tactile guide system.

As shown in Table 1 and FIG. 6, with the exception of a single participant (i.e., Participant 5), all of the other participants were able to locate the eyewash station significantly faster with a tactile guide system (i.e., the tactile guide system 534) as compared to without a tactile guide system. On average, an improvement in eyewash locating time of 35 seconds was observed, which translates to a 45% faster locating time. Thus, the efficacy of the tactile guide system 534 in the lab 500 was clearly established.

Participant 5 can be viewed as an outlier and was likely able to locate the eyewash station in about the same amount of time both with and without the tactile guide system owing to her extensive familiarity with the lab 500. If Participant 5's results are ignored, the recorded average improvement in eyewash locating time rises to 42.2 seconds, which translates to a 57% faster locating time. This suggests that the benefits of installing a tactile guide system (e.g., the tactile guide system 534) in a lab (e.g., the lab 500) may be even greater when one or more individuals working in the lab have low to moderate familiarity with the lab's layout.

TABLE 1

| Participant # | Environment Familiarity | Time to EWS with system (sec) | Time to EWS without system (sec) | Difference (sec) | % Time Decreased |
|---|---|---|---|---|---|
| 1 | Medium | 15 | 28 | 13 | 46% |
| 2 | Low | 11 | 21 | 10 | 48% |
| 3 | Low | 32 | 72 | 40 | 56% |
| 4 | Low | 17 | 152 | 135 | 89% |
| 5 | High | 14 | 12 | −2 | −17% |
| 6 | Medium | 15 | 28 | 13 | 46% |
| | Average | | | 35 | 45% |

Figure 7:
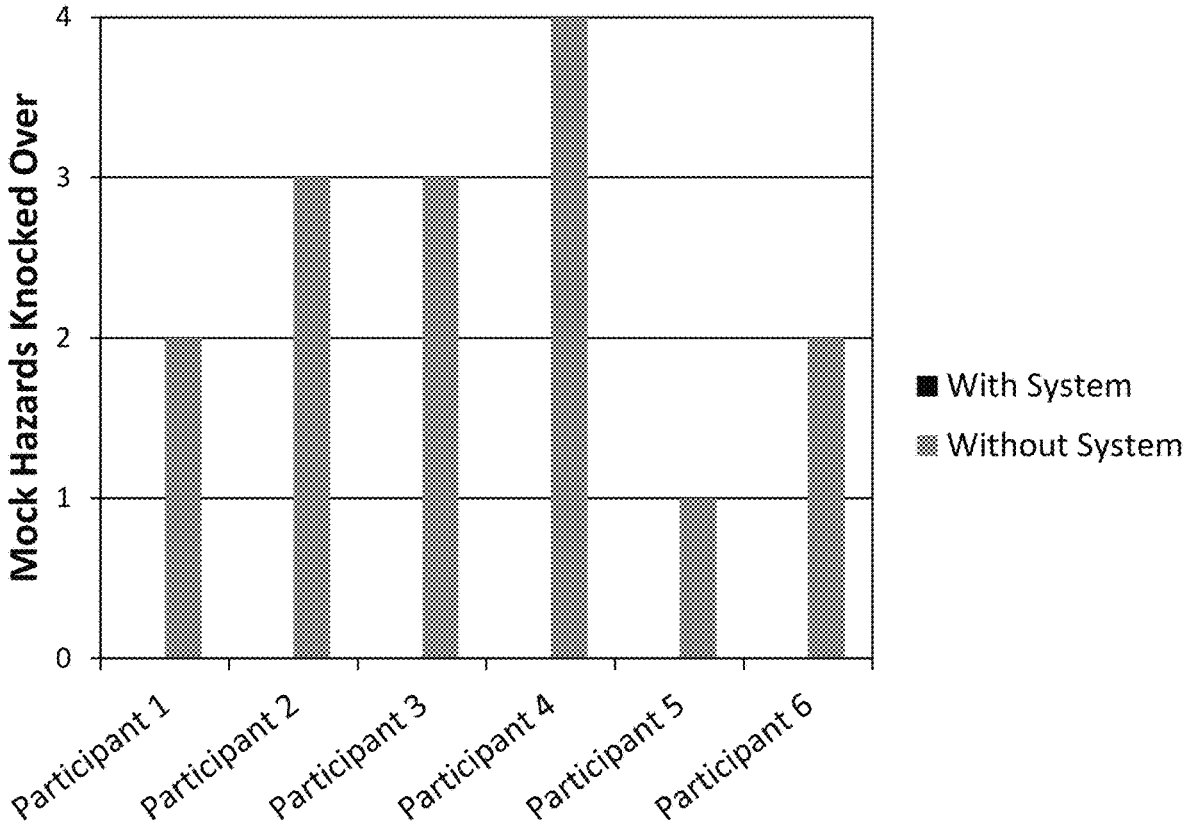
FIG. 7 is a graph indicating how many mock hazards were knocked over by Participants 1-6 when trying to locate an eyewash station with and without the use of a tactile guide system.

As shown in Table 3 and FIG. 7, all of the participants encountered at least one of the six mock hazards 540 while attempting to locate the eyewash station 520 without the presence of a tactile guide system (i.e., in the first testing zone 530). Of note, even the participant (i.e., Participant 5) with extensive knowledge of the general layout of the lab 500 was not immune. Of particular benefit from a safety standpoint, none of the participants encountered any of the mock hazards 540 while attempting to locate the eyewash station 522 with the presence of the tactile guide system 534 (i.e., in the second testing zone 532). In this manner, the tactile guide system 534 was shown to be effective in locating an eyewash station, while also preventing the vision-impaired individual from risking further harm while doing so.

TABLE 3

| Participant # | Environment Familiarity | Hazards Encountered with system (sec) | Hazards Encountered without system (sec) |
|---|---|---|---|
| 1 | Medium | 0 | 2 |
| 2 | Low | 0 | 3 |
| 3 | Low | 0 | 3 |
| 4 | Low | 0 | 4 |
| 5 | High | 0 | 1 |
| 6 | Medium | 0 | 2 |

The scope of the general inventive concepts presented herein are not intended to be limited to the particular exemplary embodiments shown and described herein. From the disclosure given, those skilled in the art will not only understand the general inventive concepts and their attendant advantages, but will also find apparent various changes and modifications to the methods and systems disclosed. It is sought, therefore, to cover all such changes and modifications as fall within the spirit and scope of the general inventive concepts, as described and/or claimed herein, and any equivalents thereof.

The invention claimed is:

1. A system for locating an eyewash station in a laboratory having a lab bench, the system comprising:

a tactile guide strip including a plurality of raised portions arranged along a length of the tactile guide strip; and a drip ridge extending the length of the tactile guide strip adjacent to the raised portions;

wherein the tactile guide strip is operable for mounting to a lower surface of the lab bench with the drip ridge being closer to an outer edge of the lab bench than the raised portions; and wherein the tactile guide strip provides a first tactile sensation upon movement of a hand along the raised portions of the tactile guide strip in a first direction and a second tactile sensation upon movement of the hand along the raised portions of the tactile guide strip in a second direction opposite the first direction.

2. The system of claim 1, wherein the raised portions form a textured surface.

3. The system of claim 2, wherein the textured surface can be felt through lab gloves.

4. The system of claim 1, wherein the tactile guide strip defines a path from a first location in the laboratory to a second location in the laboratory; and wherein the second location is closer to the eyewash station than the first location.

5. The system of claim 4, wherein the first location is more than 1 foot away from the eyewash station.

6. The system of claim 4, wherein the second location is within 6 inches of the eyewash station.

7. The system of claim 4, wherein the second location is within 1 inch of the eyewash station.

8. The system of claim 4, wherein the second location overlaps with the eyewash station.

9. The system of claim 4, wherein a gap between a first tactile guide strip on the lower surface of the lab bench and a second tactile guide strip on the lower surface of the lab bench represents the second location.

10. The system of claim 9, wherein an activation means is situated in the gap, and wherein manipulation of the activation means triggers an alarm.

11. The system of claim 10, wherein the activation means is a button.

12. The system of claim 10, wherein the alarm includes at least one of a visible alarm and an audible alarm.

13. The system of claim 4, further comprising a tactile guide arrow situated along the path, wherein the tactile guide arrow indicates a direction of travel across an open space that must be traversed before the path resumes.

14. The system of claim 13, wherein the open space is a distance of at least 1 foot.

15. The system of claim 13, wherein the tactile guide arrow includes a protective hood; and wherein the protective hood is closer to the lower surface of the lab bench than the tactile guide arrow when the tactile guide arrow is mounted to the lower surface of the lab bench; and wherein the protective hood is closer to an outer edge of the lab bench than the tactile guide arrow when the tactile guide arrow is mounted to the lower surface of the lab bench.

16. The system of claim 15, wherein the protective hood projects beyond the outer edge of the lab bench when the tactile guide arrow is mounted to the lower surface of the lab bench.

17. The system of claim 13, wherein the tactile guide arrow can be positioned through 360 degrees when the tactile guide arrow is mounted to the lower surface of the lab bench.

18. The system of claim 1, wherein adjacent raised portions abut one another.

19. The system of claim 1, wherein adjacent raised portions overlap.

20. The system of claim 1, wherein the drip ridge projects beyond the outer edge of the lab bench when the tactile guide strip is mounted to the lower surface of the lab bench.

* * * * *